US009746803B2

(12) United States Patent
Yabuki et al.

(10) Patent No.: US 9,746,803 B2
(45) Date of Patent: Aug. 29, 2017

(54) IMAGE FORMING APPARATUS HAVING FIXING UNIT WITH SUCTION PART

(71) Applicant: Konica Minolta, Inc., Chiyoda-ku, Tokyo (JP)

(72) Inventors: Shinichi Yabuki, Toyokawa (JP); Tadayasu Sekioka, Toyohashi (JP); Noboru Oomoto, Toyokawa (JP); Keita Saito, Toyokawa (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 15/040,649

(22) Filed: Feb. 10, 2016

(65) Prior Publication Data

US 2016/0246223 A1 Aug. 25, 2016

(30) Foreign Application Priority Data

Feb. 24, 2015 (JP) ..... 2015-033799

(51) Int. Cl.
*G03G 15/20* (2006.01)
*G03G 21/20* (2006.01)

(52) U.S. Cl.
CPC ..... *G03G 15/2028* (2013.01); *G03G 15/2017* (2013.01); *G03G 21/206* (2013.01)

(58) Field of Classification Search
CPC ..... G03G 15/2028; G03G 15/2017; G03G 21/206; G03G 2221/1645
USPC ..... 399/92, 93, 320, 322
See application file for complete search history.

(56) References Cited

U.S. PATENT DOCUMENTS

2012/0148290 A1* 6/2012 Asami ..... G03G 15/2042 399/92
2014/0056608 A1* 2/2014 Miura ..... G03G 15/205 399/92
2014/0376950 A1* 12/2014 Hara ..... G03G 21/206 399/92

(Continued)

FOREIGN PATENT DOCUMENTS

JP H02-116880 A 5/1990
JP H03-267954 A 11/1991

(Continued)

OTHER PUBLICATIONS

Office Action (Notification of Reason(s) for Refusal) issued on Feb. 7, 2017, by the Japanese Patent Office in corresponding Japanese Patent Application No. 2015-033799 and an English Translation of the Office Action. (6 pages).

*Primary Examiner* — Walter L Lindsay, Jr.
*Assistant Examiner* — Jessica L Eley
(74) *Attorney, Agent, or Firm* — Buchanan Ingersoll & Rooney PC

(57) ABSTRACT

An image forming apparatus includes: a fixing unit receiving through an inlet a recording medium with a transferred toner image and heat fixing the toner image to the recording medium before discharging the recording medium from an outlet; a suction part for sucking the recording medium through a recording-medium suction opening, the recording medium conveyed on a recording medium conveyance path leading to the inlet; an exhaust passage for discharging to the outside a gas sucked by the suction part; and a filter disposed in the exhaust passage and serving to capture fine particles generated from the fixing unit and sucked in by the suction part.

11 Claims, 9 Drawing Sheets

(56) References Cited

U.S. PATENT DOCUMENTS

| | | | | |
|---|---|---|---|---|
| 2015/0029525 | A1* | 1/2015 | Shimoyama ..... | B65H 3/128<br>358/1.12 |

FOREIGN PATENT DOCUMENTS

| | | | |
|---|---|---|---|
| JP | H-05-127481 | A | 5/1993 |
| JP | H08-202179 | A | 8/1996 |
| JP | 2007-219246 | A | 8/2007 |
| JP | 2010-134133 | A | 6/2010 |
| JP | 2014-44238 | A | 3/2014 |

* cited by examiner

IMAGE FORMING APPARATUS HAVING FIXING UNIT WITH SUCTION PART

RELATED APPLICATION

The priority application Number Japanese Patent Application 2015-33799 upon which this application is based is hereby incorporated by reference.

BACKGROUND OF THE INVENTION

Field of the Invention

The present invention relates to an image forming apparatus equipped with a fixing unit used for fixing a toner image onto a recording medium. Particularly, the invention features an image forming apparatus adapted to remove fine particles and the like generated from the fixing unit.

Description of the Related Art

Heretofore, electrophotographic image forming apparatuses such as copiers, printers, facsimiles and multi-functional peripheries thereof generally have a structure where a toner image is transferred from an image carrier such as a photoreceptor to a recording medium, and the recording medium with the transferred image is delivered to the fixing unit where the toner image is fixed to the recording medium.

An image forming apparatus disclosed in Patent Document 1 (JP-A No.2010-134133) is known as the image forming apparatus employing such a fixing unit. The apparatus is provided with a dedicated exhaust passage for discharging gas from a region surrounded by a cover disposed at an end of a fuser roller. Volatile organic compounds are removed by means of a filter disposed in this exhaust passage.

Further, Patent Document 2 (JP-A No.2007-219246) discloses an image forming apparatus which includes: a suction part for suction conveyance of the recording medium; and a pressure controller for controlling suction pressure to a predetermined level such that the suction conveyance of the recording medium may not encounter excessive conveyance resistance.

Unfortunately, the image forming apparatus disclosed in Patent Document 1 suffers increase in size and high cost thereof because the image forming apparatus is provided with the dedicated exhaust passage for removal of the volatile organic compounds. The image forming apparatus disclosed in Patent Document 2 includes the suction part for suction conveyance of the recording medium but is not adapted to remove the volatile organic compounds or fine particles generated from the fixing unit.

SUMMARY OF THE INVENTION

An image forming apparatus according to the invention includes:

a fixing unit receiving, through an inlet, a recording medium with a transferred toner image and heat fixing the toner image to the recording medium before discharging the recording medium from an outlet;

a suction part for sucking the recording medium through a recording-medium suction opening, the recording medium conveyed on a recording medium conveyance path leading to the inlet;

an exhaust passage for discharging to the outside a gas sucked by the suction part; and a filter disposed in the exhaust passage and serving to capture fine particles generated from the fixing unit and sucked in by the suction part.

These and other objects, advantages and features of the invention will become apparent from the following description thereof taken in conjunction with the accompanying drawings which illustrate specific embodiment of the invention.

DESCRIPTION OF THE PREFERRED EMBODIMENTS

Figure 1:
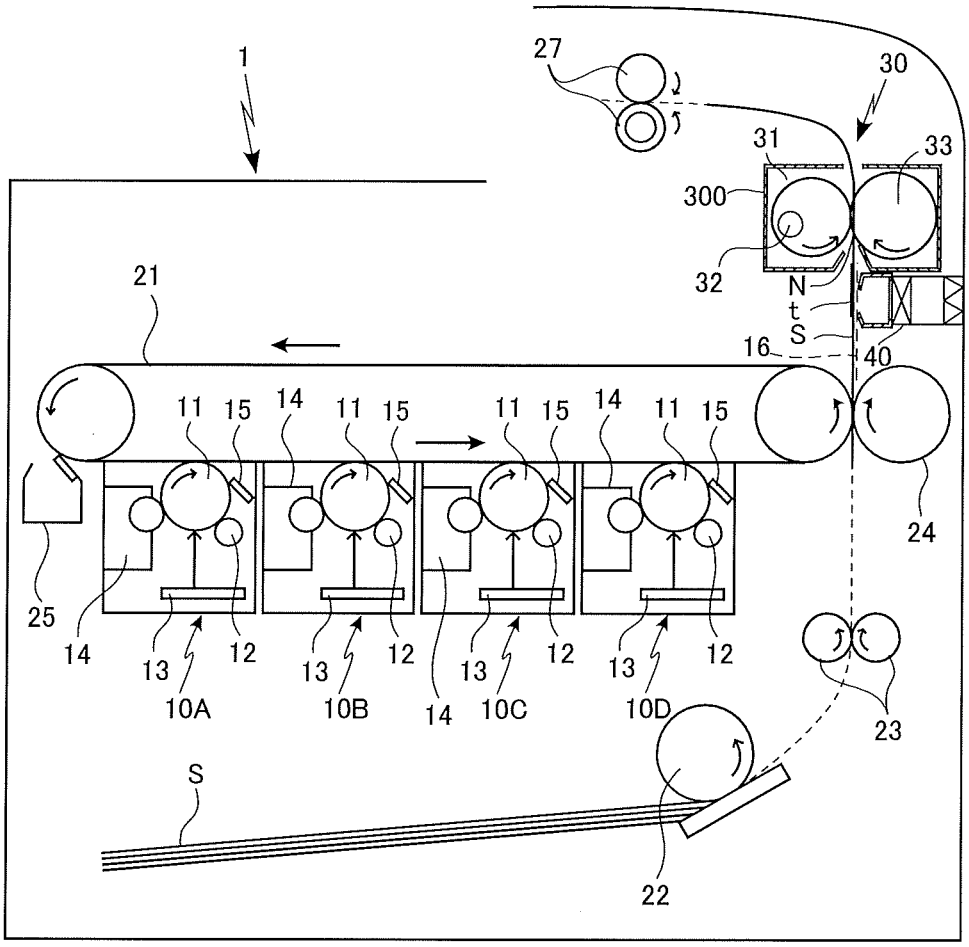
FIG. 1 is a schematic illustration diagram showing an example of an image forming apparatus according to an embodiment of the invention.

An image forming apparatus according to the invention includes: a fixing unit receiving through an inlet a recording medium with a transferred toner image and heat fixing the toner image to the recording medium before discharging the recording medium from an outlet; a suction part for sucking the recording medium through a recording-medium suction opening, the recording medium conveyed on a recording medium conveyance path leading to the inlet; an exhaust passage for discharging to the outside a gas sucked by the suction part; and a filter disposed in the exhaust passage and serving to capture fine particles generated from the fixing unit and sucked in by the suction part.

This structure negates the need for providing a dedicated exhaust passage for sucking in the fine particles and the like generated from the fixing unit because the fine particles and the like generated from the fixing unit can be sucked and captured by utilizing the suction part for sucking the recording medium. Thus, the image forming apparatus can achieve downsizing and cost reduction.

It is noted here that besides the recording-medium suction opening, the suction part may be formed with a suction capturing opening directed to the inlet. This structure permits the fine particles and the like outflowing from the inlet to be efficiently sucked through the suction capturing opening and captured by the suction part.

In the image forming apparatus including the suction capturing opening, the inlet may be provided with a determination part for determining whether or not a leading end of the recording medium is close to the inlet. The image forming apparatus can be adapted to lower a suction force of the suction part when the determination part determines that the leading end of the recording medium is close to the inlet. This structure permits the recording medium to be stably fed into the fixing unit because air flow produced by suction through the suction capturing opening can be weakened when the recording medium enters the inlet.

In the image forming apparatus including the suction capturing opening, the suction capturing opening may be provided with a lid operated by passage pressure of the recording medium passing through the recording medium conveyance path. The lid is adapted: to open the suction capturing opening as being not subjected to the passage pressure of the recording medium before the leading end of the recording medium passes the recording-medium suction opening; to close the suction capturing opening when subjected to the passage pressure applied by the leading end of the recording medium passing the recording-medium suction opening; and to open the suction capturing opening subsequently. This structure permits the fine particles and the like to be sucked and captured through both the recording-medium suction opening and the suction capturing opening before the leading end of the recording medium passes the recording-medium suction opening. When the recording medium passes the recording-medium suction opening and goes into the fixing unit, the above-described suction capturing opening is temporarily closed by the lid. Since the air flow associated with the suction through this suction capturing opening is weakened, an adverse effect on the conveyance of the recording medium is reduced. When the suction capturing opening is opened after the temporary closure by the lid, the suction capture of the fine particles and the like is restarted. The suction capture may also be restarted after the leading end of the recording medium comes as close as possible to the fixing unit.

The image forming apparatus may also be formed with a communication portion for communication between an interior of the suction part and an interior of the fixing unit. This structure permits the fine particles in the fixing unit to be directly sucked and captured in the suction part. Further, the structure negates the need for providing the suction capturing opening, obviating the occurrence of the air flow adversely affecting the conveyance of the recording medium.

In the image forming apparatus including the communication portion, the recording-medium suction opening may be provided with a lid operated by passage pressure of the recording medium passing through the recording medium conveyance path. The lid is adapted to close the recording-medium suction opening as not being subjected to the passage pressure of the recording medium before the leading end of the recording medium reaches the recording-medium suction opening, and to open the recording-medium suction opening under the passage pressure of the recording medium when the leading end of the recording medium starts to pass the recording-medium suction opening. This structure permits the fine particles and the like to be efficiently sucked and captured through the communication portion by closing the recording-medium suction opening when the suction part need not suck and convey the recording medium. When the recording medium starts to pass the recording-medium suction opening, the suction part sucks and conveys the recording medium while the suction capture of the fine particles and the like through the communication portion is continued.

In the image forming apparatus including the communication portion, the inlet may be provided with an inlet door for closing this inlet. The inlet door is adapted to be opened by the passage pressure of the recording medium so as to allow the passage of the recording medium. This structure can prevent the diffusion of the fine particles and the like from the fixing unit into the apparatus through the inlet, while permitting the suction capture of the fine particles and the like through the communication portion.

In the image forming apparatus according to the invention, the outlet may be provided with an outlet door for closing this outlet. The outlet door can be adapted to be opened by the passage pressure of the recording medium so as to allow the passage of the recording medium. This structure can prevent the diffusion of the fine particles and the like from the fixing unit into the apparatus through the outlet, while permitting the suction capture of the fine particles and the like through the suction capturing opening or the communication portion.

In the image forming apparatus according to the invention, the suction part may be operated without feeding the recording medium while electric power is supplied to the fixing unit. At the time of startup of the fixing unit, the suction part may be so operated as to generate a greater suction force than a suction force applied to the suction conveyance of the recording medium.

Next, an image forming apparatus according to an embodiment of the invention is specifically described with reference to the accompanying drawings. It is to be noted that the image forming apparatus according to the invention is not limited to the following embodiments but may be otherwise variously embodied without departing from the scope of the invention.

As shown in FIG. 1, an image forming apparatus 1 according to the embodiment of the invention is equipped with four imaging cartridges 10A to 10D.

Each of the imaging cartridges 10A to 10D includes: a photoreceptor 11; a charger unit 12 for electrically charging a surface of this photoreceptor 11; an exposure unit 13 for forming an electrostatic latent image on the surface of the photoreceptor 11 by exposing the charged surface of the photoreceptor 11 to light according to image information; a developing unit 14 for forming a toner image by supplying a toner to the electrostatic latent image formed on the surface of the photoreceptor 11; and a cleaning unit 15 for removing residual toner on the surface of the photoreceptor 11 after transfer of the toner image formed on the photoreceptor surface 11 to an intermediate transfer belt 21.

The developing units 14 of the imaging cartridges 10A to 10D respectively contain toners of different colors, namely, black toner, yellow toner, magenta toner and cyan toner.

In this image forming apparatus 1, the imaging cartridges 10A to 10D each form the toner image of each color by performing the steps of: electrically charging the surface of the photoreceptor 11 by means of the charger unit 12; forming the electrostatic latent image on the surface of the photoreceptor 11 by means of the exposure unit 13 exposing the charged surface of the photoreceptor 11 to light according to the image information; and forming the toner image of each color on the photoreceptor surface 11 by means of the developing unit 14 supplying the toner of each color to the electrostatic latent image on the photoreceptor surface 11.

Subsequently, the toner images of the respective colors formed on the respective photoreceptor surfaces 11 of the imaging cartridges 10A to 10D are sequentially transferred onto the intermediate belt 21 so as to form a composite toner image on this intermediate transfer belt 21. In the meantime, the toners remaining on the respective photoreceptor surfaces 11 after image transfer are removed therefrom by means of the respective cleaning units 15.

On the other hand, a recording medium S stored in the image forming apparatus 1 is delivered to a timing roller 23 by a paper feed roller 22. The timing roller 23 feeds the recording medium S to place between the intermediate transfer belt 21 and a transfer roller 24 in a suitable timing such as to permit the toner image formed on the intermediate transfer belt 21 to be transferred onto this recording medium S. Then, the toner un-transferred to the recording medium S and remaining on the intermediate transfer belt 21 is removed therefrom by means of a second cleaning unit 25.

The recording medium S with the toner image transferred in the above-described manner is delivered to a fixing unit 30 via a recording medium conveyance path 16. In this fixing unit 30, the toner image is fixed to the recording medium S. Subsequently, the recording medium S with the fixed toner image is discharged by a discharge roller 27.

The fixing unit 30 is provided with a heating element 32, such as a halogen heater, on an inner periphery of the fuser roller 31 such that the fuser roller 31 is heated by this heating element 32.

A pressure roller 33 is disposed in opposed relation with the fuser roller 31. The pressure roller 33 is in pressure contact with the fuser roller 31 so as to form a nip N between the pressure roller 33 and the fuser roller 31. In this state, the pressure roller 33 is rotated to bring the fuser roller 31 into driven rotation in conjunction with the rotation of the pressure roller 33.

Then, the recording medium S with the transferred toner image t is fed into the nip N between the pressure roller 33 and the fuser roller 31, where the toner image t is fixed to the recording medium S by heating and pressing the recording medium S.

Figure 2:
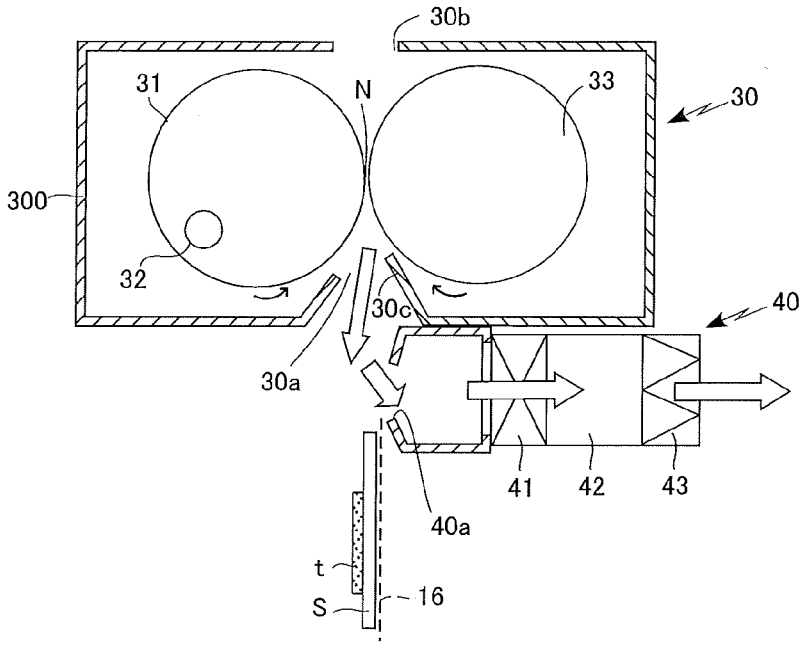
FIG. 2 is a schematic illustration diagram illustrating a fixing unit and a suction part employed by the image forming apparatus of FIG. 1.

In the fixing unit 30, the pressure roller 33 and the fuser roller 31 are covered by a case 300. As shown in FIG. 2, the case 300 is formed with an inlet 30*a* in a lower side thereof such as to allow the entry of the recording medium S conveyed via the recording medium conveyance path 16. The case 300 is formed with an outlet 30*b* in an upper side thereof such as to allow the discharge of the recording medium S with the toner image t fixed thereto. The case 300 is further formed with a guide 30*c* in the vicinity of the inlet 30*a* such as to guide the recording medium S to the nip N.

A suction part 40 for sucking the recording medium S through a recording-medium suction opening 40*a* is provided at place on a back side of a conveyance surface of the recording medium conveyance path 16 and near a downside of the inlet 30*a* such as to stably guide the recording medium S from the inlet 30*a* to the nip N, the recording medium S conveyed on the recording medium conveyance path 16. The recording-medium suction opening 40*a* is formed in a slit-like configuration, for example.

The suction part 40 includes a fan 41 for suction of the recording medium S. The suction part 40 further includes an exhaust passage 42 for discharging the gas sucked in by the fan 41 to the outside of the image forming apparatus 1. This exhaust passage 42 is provided with a filter 43 for capturing the fine particles and the like including ultra fine particles (UFP), which are generated from the fixing unit 30 and sucked in by the suction part 40.

Figure 3:
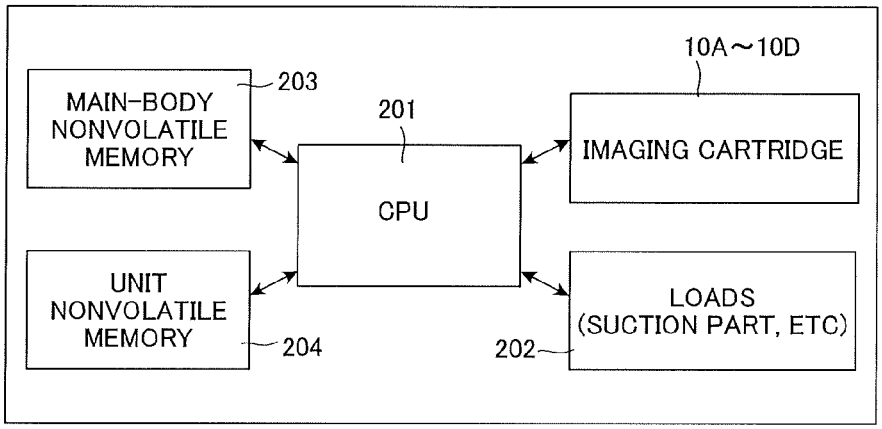
FIG. 3 is a block diagram schematically showing a control system of the image forming apparatus of FIG. 1.

FIG. 3 shows an example of a control structure of the image forming apparatus 1. The image forming apparatus 1 includes a CPU 201 for controlling the imaging cartridges 10A to 10D and the like. The CPU 201 also controls: individual motors for paper conveyance, toner refill, and image formation; and various loads 202 on the fixing unit 30, the suction part 40 and the like.

The CPU 201 is connected with a main-body rewritable nonvolatile memory 203 such that measured data obtained by the CPU 201 can be stored in the nonvolatile memory 203. Further, a consumable article unit is provided with a rewritable nonvolatile memory 204 so as to store information on the consumable article unit and the like under the control of the CPU 201.

In such an image forming apparatus 1, the fine particles and the like generated from the fixing unit 30 and present around the inlet 30*a* are sucked into the suction part 40 through the recording-medium suction opening 40*a* during printing on the recording medium S as indicated by blank arrows in FIG. 2. Thus, the diffusion of fine particles and the like in the image forming apparatus can be prevented. Since this suction part 40 is provided with the filter 43, the sucked fine particles and the like are captured by the filter 43 so that a clean air is discharged to the outside. In this manner, the apparatus utilizes the suction part 40 to suck and capture the fine particles and the like generated from the fixing unit 30 and hence, negates the need for providing an exhaust passage specialized for sucking such fine particles and the like. The apparatus can achieve the downsizing and cost reduction.

Figure 4:
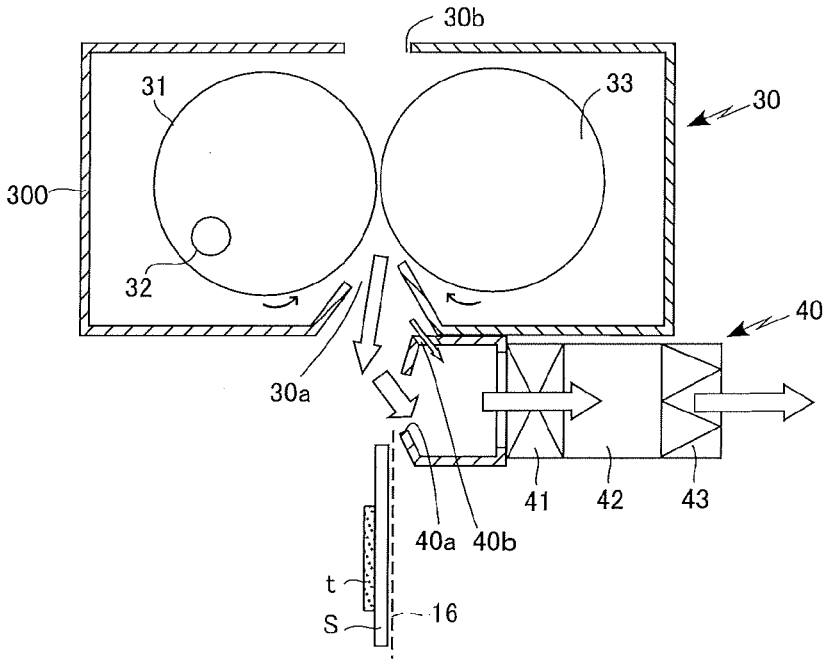
FIG. 4 is a schematic illustration diagram illustrating a fixing unit and a suction part employed by the image forming apparatus of FIG. 1.

Next, an image forming apparatus 1 according to another embodiment is described with reference to FIG. 4. In addition to the recording-medium suction opening 40*a*, this image forming apparatus 1 further includes a suction capturing opening 40*b* formed at place of an upper side of the suction part 40 and directed to the inlet 30*a*. This structure is adapted for efficient suction of the fine particles and the like generated from the fixing unit 30 through the suction capturing opening 40*b*. This structure has an advantage of negating the need for making special change in the fixing unit 30 because the suction capturing opening 40*b* is formed at the suction part 40.

Figure 5:
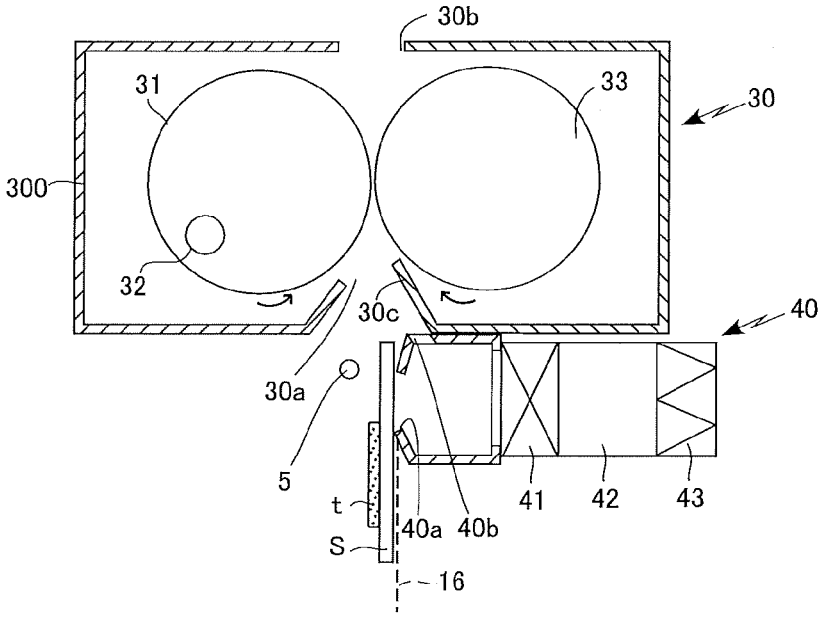
FIG. 5 is a schematic illustration diagram illustrating a fixing unit and a suction part employed by the image forming apparatus of FIG. 1.
Figure 6:
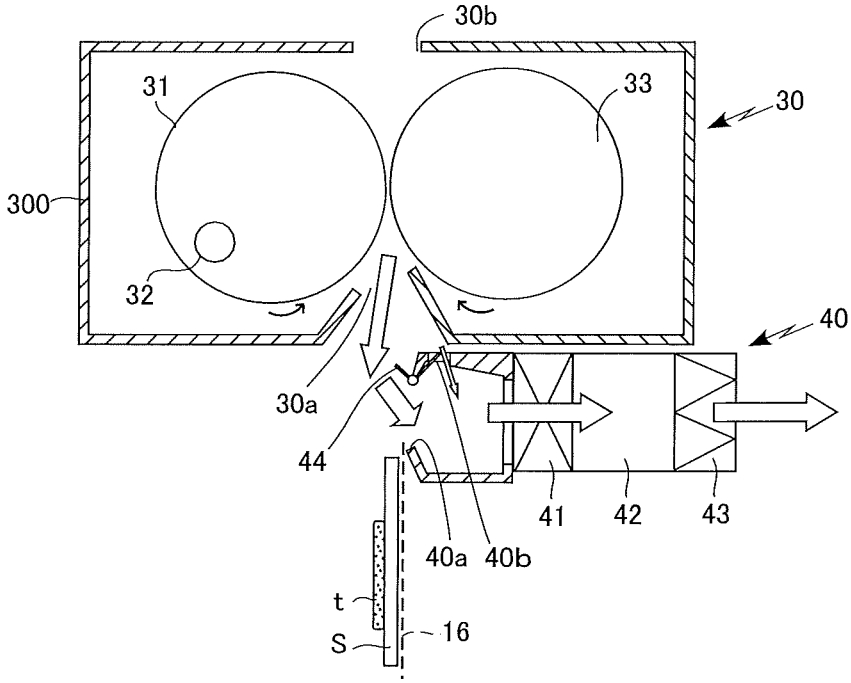
FIG. 6 is a schematic illustration diagram illustrating a fixing unit and a suction part employed by the image forming apparatus of FIG. 1.

Next, an image forming apparatus 1 according to another embodiment is described with reference to FIG. 5. Similarly to the image forming apparatus 1 shown in FIG. 4, the image forming apparatus 1 of this embodiment includes the suction capturing opening 40*b*. This image forming apparatus further includes a determination part such as an optical sensor 5 which determines whether or not a leading end of the recording medium S is close to the inlet 30*a*. FIG. 5 shows the leading end of the recording medium S having just passed the recording-medium suction opening 40*a* as an illustration of a state where the leading end of the recording medium S is close to the inlet 30*a*. However, this illustration is a mere example. The adjacency state may also be defined as a state where the recording medium S is further advanced to bring the leading end thereof in between the suction part 40 and the inlet 30*a*. Further, the location of the sensor 5 is not limited to the position shown in FIG. 5. For example, the sensor may be disposed at place upstream of the illustrated location in the recording medium conveyance path such that whether or not the leading end of the recording medium S is close to the inlet 30*a* is determined based on the measured time elapsed from the detection of the recording medium.

When the sensor 5 determines that the recording medium S is close to the inlet 30*a*, the CPU 201 lowers the suction force of the suction part 40 from a normal suction level applied to the suction conveyance of the recording medium S. If such a control is provided, an adverse effect on the conveyance of the recording medium S can be reduced because the air flow associated with the suction through the suction capturing opening 40*b* can be weakened when the recording medium S is guided into the inlet 30*a*. By regulating the suction force of the suction part 40, the intake volume of the suction part 40 can be adjusted, without impairing the primary conveyance function, in accordance with the progress of the recording medium S on the suction part 40. It is noted that the suction force on the fine particles and the like is weakened only for a moment when the leading end of the recording medium S reaches a midpoint between the suction part 40 and the fixing unit 30. In principle, however, the suction part is always capable of sucking in the fine particles and the like regardless of the presence of the recording medium S.

Next, an image forming apparatus 1 according to another embodiment is described with reference to FIG. 6, FIG. 7, FIG. 8 and FIG. 9. The image forming apparatus 1 of this embodiment includes the suction capturing opening 40*b* similarly to the image forming apparatus 1 of FIG. 4. The image forming apparatus further includes a lid 44 at the suction capturing opening 40*b*. The lid is operated by a passage pressure of the recording medium S passing through the recording medium conveyance path 16.

Figure 7:
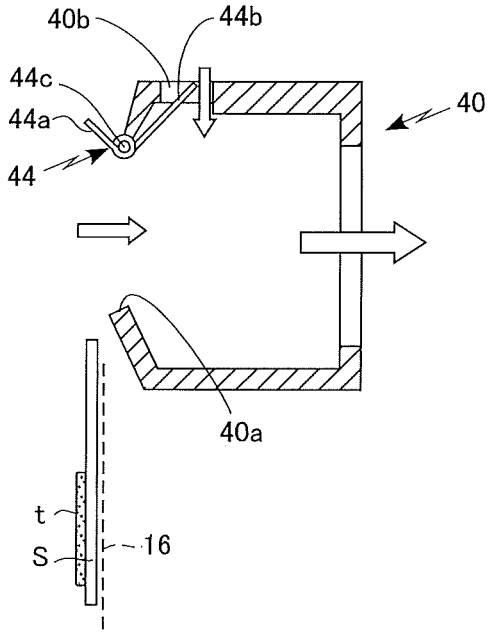
FIG. 7 is a schematic illustration diagram showing in enlarged dimension a part of the suction part of FIG. 6 and illustrating a motion of a lid provided at this suction part.

As shown in enlarged dimension in FIG. 7, the lid 44 is formed of an elastic member such as a leaf spring or coil spring. One end of the lid defines a detection piece 44*a* located at a position to receive the passage pressure of the recording medium S. The other end of the lid defines a lid portion 44*b* located in the suction capturing opening 40*b*. These detection piece 44*a* and lid portion 44*b* are adapted for unitary rotation about a shaft portion 44*c* which is located at an upper side of the recording-medium suction opening 40*a* and has an axis perpendicular to a conveyance direction of the recording medium S. The lid 44 having such a structure is adapted to open the suction capturing opening 40*b* as not being subjected to the passage pressure of the recording medium S before the leading end of the recording medium S passes the recording-medium suction opening 40*a*.

Figure 8:
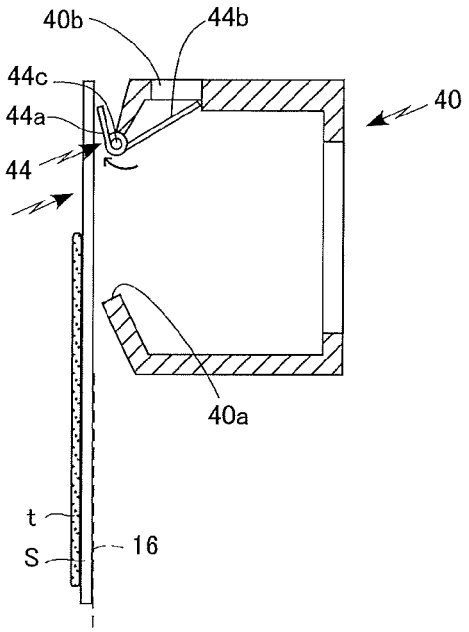
FIG. 8 is a schematic illustration diagram showing in enlarged dimension a part of the suction part of FIG. 6 and illustrating a motion of a lid provided at this suction part.

When the detection piece 44*a* is subjected to the passage pressure applied by the leading end of the recording medium S passing the recording-medium suction opening 40*a*, as shown in FIG. 8, the lid 44 rotates about the shaft portion 44*c* against an unillustrated return spring so that the suction capturing opening 40*b* is closed by the lid portion 44*b*. At this time, the lid portion 44*b* is contacted against an inside wall of the suction capturing opening 40*b* so that the lid 44 is flexed.

Figure 9:
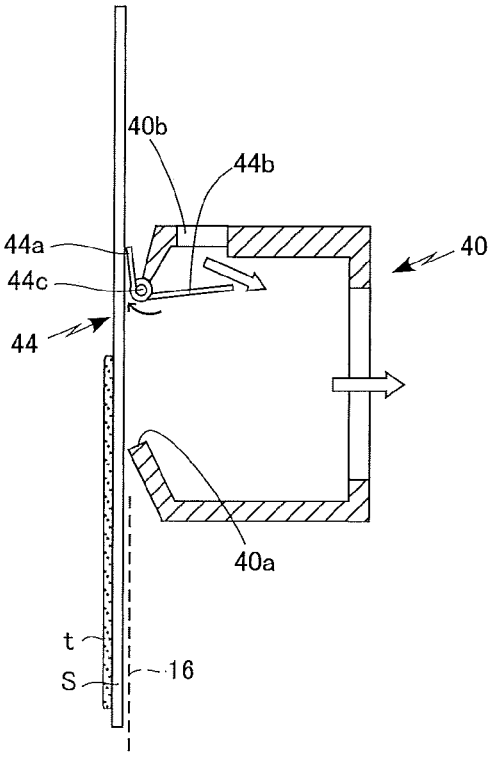
FIG. 9 is a schematic illustration diagram showing in enlarged dimension a part of the suction part of FIG. 6 and illustrating a motion of a lid provided at the suction part.

Because of the detection piece 44*a* receiving a frictional force by contact with the recording medium S being conveyed, the lid 44 is rotated while maintaining a distal end of the lid portion 44*b* in contact against the inside wall of the suction capturing opening 40*b*. When the distal end of the lid portion 44*b* is moved beyond a lower corner of the inside wall of the suction capturing opening 40*b*, the distal end of the lid portion 44*b* enters inside the suction part 40, as shown in FIG. 9, so that the suction capturing opening 40*b* is opened. The suction capture through this suction capturing opening 40*b* is restarted. When the recording medium S passes the recording-medium suction opening 40*a*, the lid is returned to the state shown in FIG. 7 by the above-described return spring.

This structure is adapted to suck in and capture the fine particles and the like through both the recording-medium suction opening 40*a* and the suction capturing opening 40*b*. When the recording medium S passes the recording-medium suction opening 40*a* and comes close to the fixing unit 30, the suction capturing opening 40*b* is temporarily closed to reduce the influence of the air flow. Therefore, the recording medium S can be conveyed to the fixing unit 30 in a stable manner. After the temporary closure of the suction capturing opening 40*b*, this suction capturing opening 40*b* is opened to restart the suction capture of the fine particles and the like.

Figure 10:
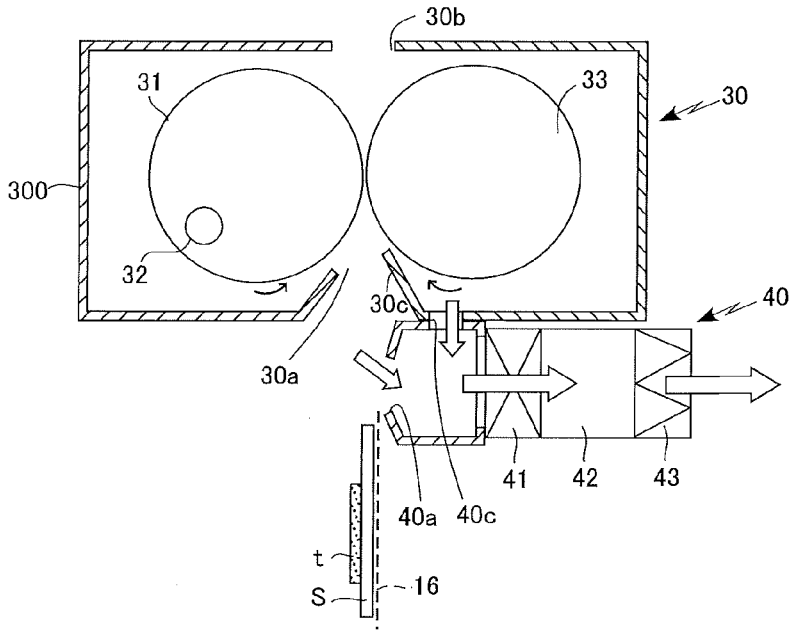
FIG. 10 is a schematic illustration diagram illustrating a fixing unit and a suction part employed by the image forming apparatus of FIG. 1.

Next, an image forming apparatus 1 according to another embodiment is described with reference to FIG. 10. This image forming apparatus 1 is formed with a communication portion 40*c* for communication between an interior of the suction part 40 and an interior of the fixing unit 30. This structure permits the fine particles and the like in the fixing unit 30 to be directly sucked into and captured in the suction part 40 via the communication portion 40*c*. Further, the apparatus does not include the suction capturing opening 40*b* and hence, the occurrence of air flow adversely affecting the conveyance of the recording medium S can be avoided.

Next, an image forming apparatus 1 according to another embodiment is described with reference to FIG. 11. The image forming apparatus 1 of this embodiment includes the communication portion 40*c* similarly to the image forming apparatus 1 of FIG. 10. The image forming apparatus further includes a lid 45 at the recording-medium suction opening 40*a*. The lid is operated by the passage pressure of the recording medium S passing through the recording medium conveyance path 16.

This lid 45 includes a detection piece 45*a* to receive the passage pressure of the recording medium S, and a lid portion 45*b* for closing the recording-medium suction opening 40*a*. The lid is adapted to rotate about a shaft portion 45*c* which is located at a lower side of the recording-medium suction opening 40*a* and has an axis perpendicular to the conveyance direction of the recording medium S. This lid 45 is adapted to close the recording-medium suction opening 40*a* as not being subjected to the passage pressure of the recording medium S before the leading end of the recording medium S passes the recording-medium suction opening 40*a*. The lid is equipped with an unillustrated return spring for urging the lid 45 in a direction to close the opening.

Figure 11:
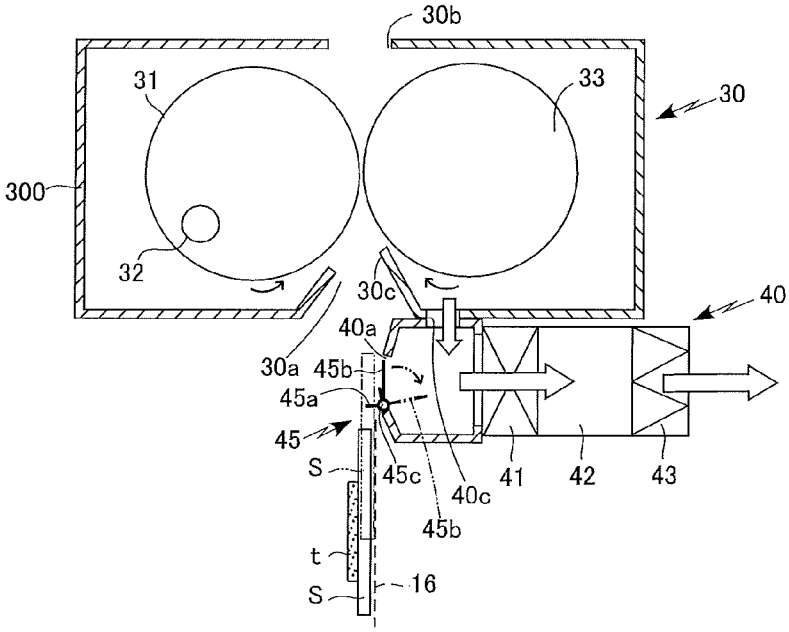
FIG. 11 is a schematic illustration diagram illustrating a fixing unit and a suction part employed by the image forming apparatus of FIG. 1.

According to the structure equipped with such a lid 45, when the leading end of the recording medium S starts to pass the recording-medium suction opening 40*a*, the detection piece 45*a* is subjected to the passage pressure of the recording medium S, thus driving the lid to open the recording-medium suction opening 40*a* against the return spring, as indicated by two-dot chain lines in FIG. 11. According to this structure, the lid 45 closes the recording-medium suction opening 40*a* before the recording medium S is delivered to the suction part 40 and hence, the fine particles and the like in the fixing unit 30 can be efficiently sucked and captured in the suction part 40 through the communication portion 40*c*. When the recording medium S passes the recording-medium suction opening 40*a*, this recording-medium suction opening 40*a* is opened to permit the suction conveyance of the recording medium S by the suction part 40 while the suction capture of the fine particles and the like through the communication portion 40*c* is continued. After the passage pressure on the detection piece 45*a* is eliminated due to the passage of the recording medium S over the recording-medium suction opening 40*a*, the lid 45 is driven by the return spring to automatically close the recording-medium suction opening 40*a*.

Figure 12:
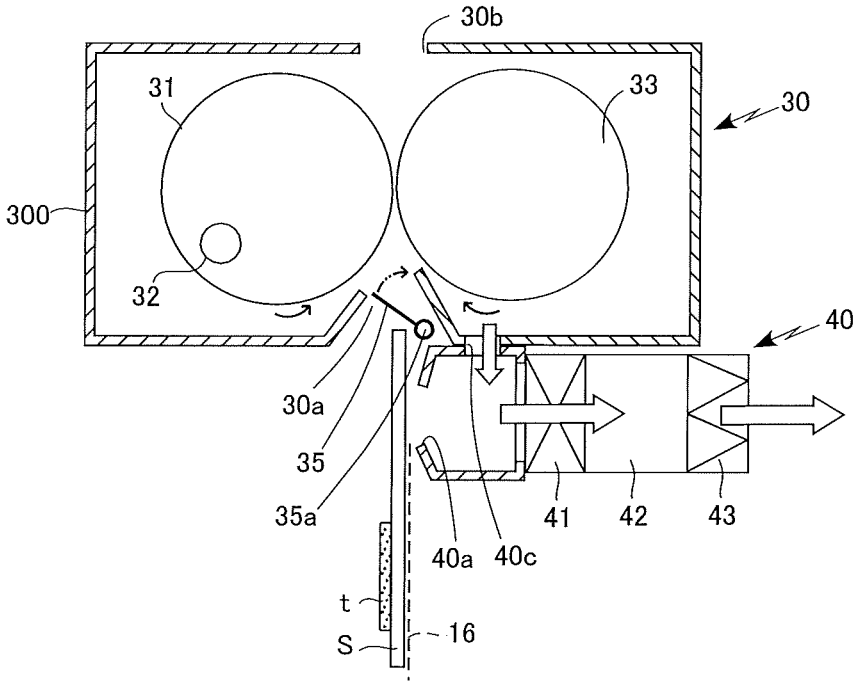
FIG. 12 is a schematic illustration diagram illustrating a fixing unit and a suction part employed by the image forming apparatus of FIG. 1.

Next, an image forming apparatus 1 according to another embodiment is described with reference to FIG. 12. The image forming apparatus 1 of this embodiment includes the communication portion 40*c* similarly to the image forming apparatus 1 of FIG. 10. The image forming apparatus further includes an inlet door 35 at the inlet 30*a* such as to close this inlet 30*a*. The inlet door 35 is opened by the passage pressure of the recording medium S so as to allow the passage of the recording medium S. Further, this inlet door 35 is adapted to automatically close the inlet 30*a* as driven by an unillustrated return spring after the passage of the recording medium 30*a*. This structure is adapted not only to prevent the fine particles and the like in the fixing unit 30 from being diffused into the apparatus through the inlet 30*a* but also to efficiently suck and capture the fine particles and the like through the communication portion 40*c*.

Figure 13:
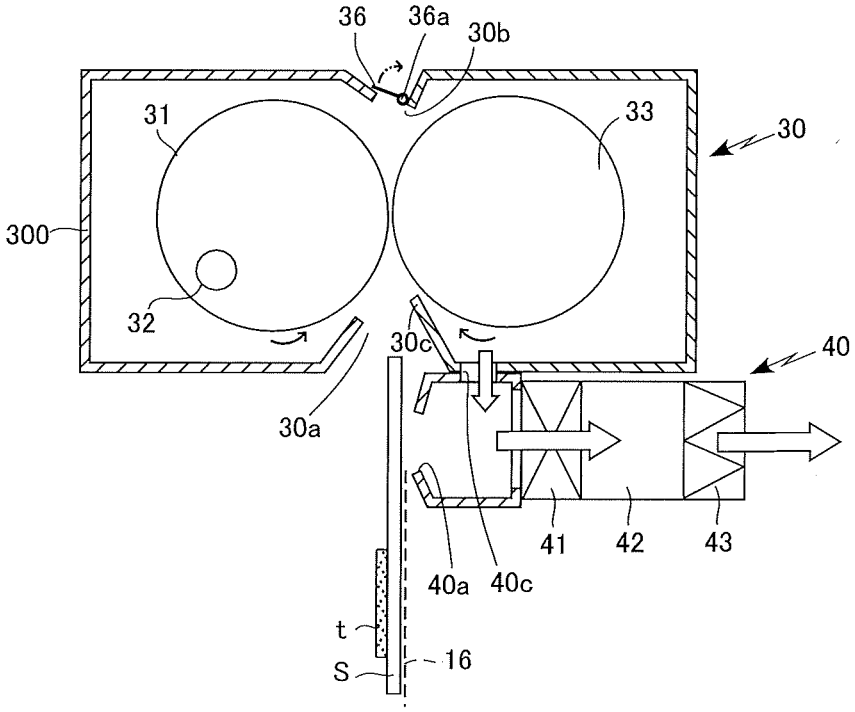
FIG. 13 is a schematic illustration diagram illustrating a fixing unit and a suction part employed by the image forming apparatus of FIG. 1.

Next, an image forming apparatus 1 according to another embodiment is described with reference to FIG. 13. The image forming apparatus 1 of this embodiment includes the communication portion 40*c* similarly to the image forming apparatus 1 of FIG. 10. The image forming apparatus further includes an outlet door 36 at the outlet 30*b* such as to close this outlet 30*b*.This outlet door 36 is opened by the passage pressure of the recording medium S so as to allow the passage of the recording medium S. After the passage of the recording medium S, the outlet door 36 automatically closes the outlet 30*b* as driven by an unillustrated return spring. This structure is adapted not only to prevent the fine particles and the like in the fixing unit 30 from being diffused into the apparatus through the outlet 30*b* but also to efficiently suck and capture the fine particles and the like through the communication portion 40*c*. Alternatively, a structure including both the inlet door 35 for closing the inlet 30*a* and the outlet door 36 for closing the outlet 30*b* may also be made. Further, the structure including the outlet door 36 is applicable not only to the structure including the communication portion 40*c* but also to the structure formed with the suction capturing opening 40*b*.

Figure 14:
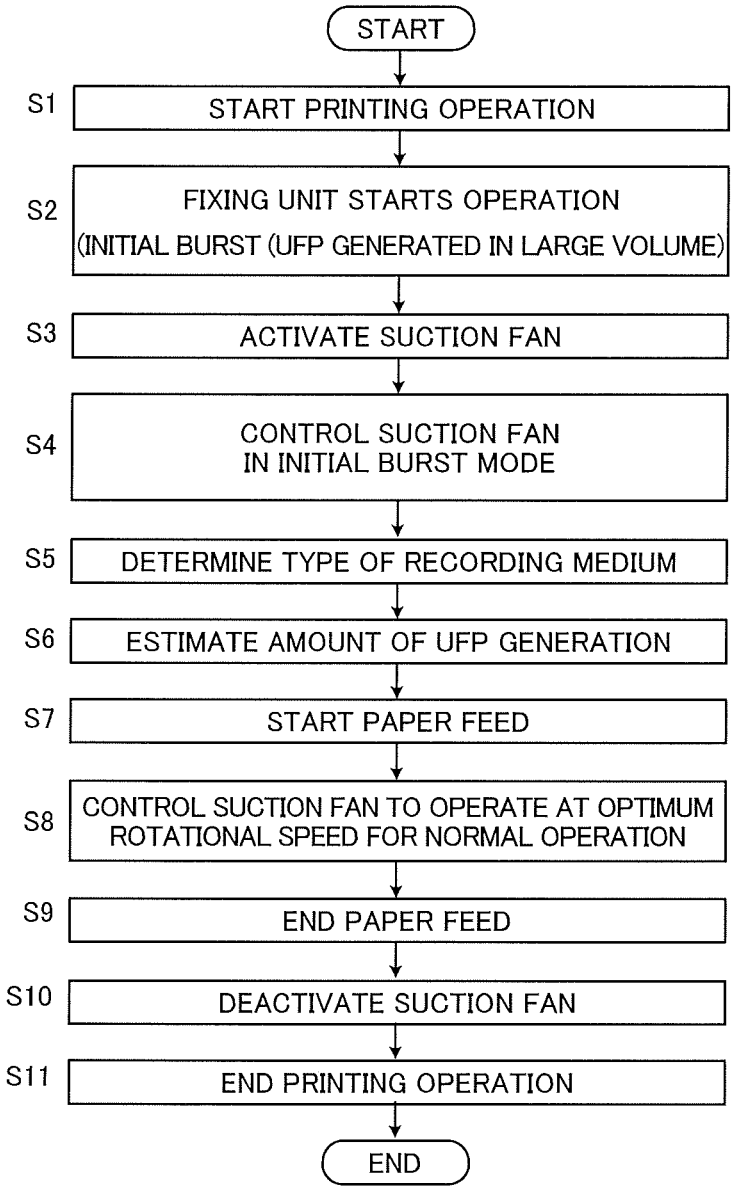
FIG. 14 is a flow chart showing an example of operations of the image forming apparatus of FIG. 1.
Figure 15:
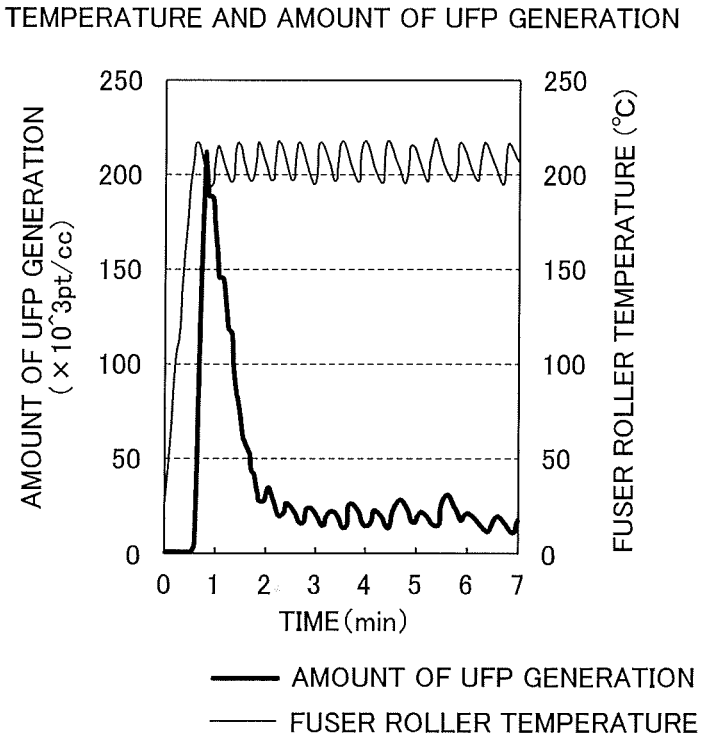
FIG. 15 is a graph illustrating change with time of the amount of fine particles generated from the fixing unit of the image forming apparatus and change with time of the temperature of the fuser roller thereof.

Next, an example of control by the CPU 201 of the image forming apparatus 1 is described with reference to FIG. 14 and FIG. 15. In FIG. 14 and FIG. 15, the fine particles and the like are written as "UFP".

First, the image forming apparatus 1 starts a printing operation (Step S1). When the fixing unit 30 starts its operation (Step S2), initial burst occurs. In this initial burst, temperature rise of the fuser roller 31 in combination with increase in the amount of fine particle generation is encountered, as shown in FIG. 15. When the temperature of the fuser roller 31 becomes substantially constant with time, the amount of fine particle generation substantially stays constant.

Next, the CPU 201 activates the fan 41 of the suction part 40 (Step S3) and controls this fan 41 in an initial burst mode (Step S4). Under this control, the rotational speed of the fan 41 is set higher than a normal rotational speed for suction conveyance of the recording medium S so that the suction force of the suction part 40 is stronger than a normal suction force applied to the suction conveyance of the recording medium S. Thus, the fine particles and the like rapidly increased in the generation amount in conjunction with the temperature rise of the fuser roller 31 can be forcibly sucked and captured. With the recording medium S yet to be fed, the suction capture of fine particles and the like is performed by driving the suction part 40.

Next, the CPU 201 determines the type of a recording medium S to be printed (Step S5) and further estimates the amount of fine particle generation (Step S6). The amount of fine particle generation can be estimated based on, for example, the amount of toner used for printing images or the fixing temperature. If the fixing temperature is high, for example, the amount of fine particle generation increases. As to the fixing temperature used for estimation of the amount of fine particle generation, the temperature of the fuser roller 31 may be actually detected by means of a thermistor or the like or otherwise, a preset temperature for the fixing unit 30 may also be used.

Next, the CPU 201 starts to feed paper by operating the paper feed roller 22 and the like (Step S7) and controls the fan 41 to operate at a suitable rotational speed for-stable conveyance of the recording medium S (Step S8). Incidentally, the CPU may be programmed to start the paper feed after a lapse of one minute from power-on. After the passage of the recording medium S through the fixing unit 30 (Step S9), for example, the CPU 201 stops the fan 41 (Step S10) and terminates the printing operation (Step S11). It is noted that the fan 41 is not necessarily stopped concurrently with the passage of the recording medium S through the fixing unit 30. The suction capture of the fine particles and the like may be continued for a while by stopping the fan 41 after a lapse of a given time period from the passage of the recording medium.

In the case where the leading end of the recording medium S is detected by the sensor 5 shown in FIG. 5, the stable conveyance of the recording medium S is ensured by lowering the suction force of the suction part 40 from the level applied to the normal suction conveyance of the recording medium S (the suction force applied in Step S8) when subsequent to the Step S8 shown in FIG. 14, the leading end of the recording medium S is detected by the sensor 5. When a trailing end of the recording medium S is detected by the sensor 5 or when a given time period has elapsed from the detection of the leading end of the recording medium S by the sensor 5 (when the recording medium S reaches the nip N, for example), the CPU may return the suction force to the normal level before proceeding to the subsequent Step S9.

In a case where the suction force of the suction part 40 is increased when the fine particles and the like are generated in large volume, the flow of the fine particles and the like into the filter 43 increases. Meanwhile, the increased suction force leads to the increase in air velocity, which lowers the fine-particle capture rate of the filter 43. Therefore, what is necessary is not just to increase the suction force of the suction part 40. It is desirable to control the rotational speed of the fan 41 in a manner to provide the suction force of the suction part 40 within a range for stable conveyance of the recording medium S, and in consideration of the change in the inflow of fine particles and the like into the filter 43 related with the amount of fine particle generation and the change in the capture rate of the filter 43 related with the velocity of air flow into the filter 43. It is not particularly necessary to consider the stable conveyance of the recording medium S as for the suction capture of the fine particles and the like during the initial burst.

Although the present invention has been fully described by way of examples, it is to be noted that various changes and modifications will be apparent to those skilled in the art.

Therefore, unless otherwise such changes and modifications depart from the scope of the present invention, they should be construed as being included therein.

The invention claimed is:

1. An image forming apparatus comprising:

a fixing unit receiving through an inlet a recording medium with a transferred toner image and heat fixing the toner image to the recording medium before discharging the recording medium from an outlet;

a suction part for sucking the recording medium through a recording-medium suction opening, the recording medium sucked and conveyed on a recording medium conveyance path leading to the inlet with the suction part;

an exhaust passage for discharging to the outside a gas sucked by the suction part; and a filter disposed in the exhaust passage and serving to capture fine particles generated from the fixing unit and sucked in by the suction part.

2. The image forming apparatus according to claim 1, wherein besides the recording-medium suction opening, the suction part is formed with a suction capturing opening directed to the inlet.

3. The image forming apparatus according to claim 2, wherein the inlet is provided with a determination part for determining whether or not a leading end of the recording medium is close to the inlet, and a suction force of the suction part is lowered when the determination part determines that the leading end of the recording medium is close to the inlet.

4. The image forming apparatus according to claim 2, wherein the suction capturing opening is provided with a lid operated by passage pressure of the recording medium passing through the recording medium conveyance path, and the lid is operative: to open the suction capturing opening as being not subjected to the passage pressure of the recording medium before the leading end of the recording medium passes the recording-medium suction opening; to close the suction capturing opening when subjected to the passage pressure applied by the leading end of the recording medium passing the recording-medium suction opening; and to open the suction capturing opening subsequently.

5. The image forming apparatus according to claim 2, wherein the suction capturing opening is closer than the recording-medium suction opening, relative to a direction of the recording medium conveyance path, to the inlet.

6. The image forming apparatus according to claim 1, wherein a communication portion for communication between an interior of the suction part and an interior of the fixing unit is formed.

7. The image forming apparatus according to claim 6, wherein the recording-medium suction opening is provided with a lid operated by passage pressure of the recording medium passing through the recording medium conveyance path, and the lid closes the recording-medium suction opening as not being subjected to the passage pressure of the recording medium before a leading end of the recording medium reaches the recording-medium suction opening, but opens the recording-medium suction opening under the passage pressure of the recording medium when the leading end of the recording medium starts to pass the recording-medium suction opening.

8. The image forming apparatus according to claim 6, wherein the inlet is provided with an inlet door for closing this inlet, and the inlet door is opened by the passage pressure of the recording medium to allow the passage of the recording medium.

9. The image forming apparatus according to claim 1, wherein the outlet is provided with an outlet door for closing this outlet, and the outlet door is opened by the passage pressure of the recording medium to allow the passage of the recording medium.

10. The image forming apparatus according to claim 1, wherein the suction part is operated while electric power is supplied to the fixing unit.

11. The image forming apparatus according to claim 10, wherein at the time of startup of the fixing unit, the suction part is operated to generate a greater suction force than a suction force applied to suction conveyance of the recording medium.

* * * * *